US008382011B1

(12) United States Patent
Baldacchino

(10) Patent No.: US 8,382,011 B1
(45) Date of Patent: Feb. 26, 2013

(54) SHOWER HEAD APPARATUS

(76) Inventor: Joseph M. Baldacchino, Point Cook (AU)

( * ) Notice: Subject to any disclaimer, the term of this patent is extended or adjusted under 35 U.S.C. 154(b) by 260 days.

(21) Appl. No.: 12/877,204

(22) Filed: Sep. 8, 2010

(51) Int. Cl.
*B05B 15/08* (2006.01)

(52) U.S. Cl. ..... 239/587.1; 239/587.2

(58) Field of Classification Search ..... 239/587.1, 239/587.2, 587.4, 587.5, 587.6; 4/601, 605
See application file for complete search history.

(56) References Cited

U.S. PATENT DOCUMENTS 2,448,792 A 9/1948 Fraser
2,965,313 A 12/1960 Jay
3,375,532 A * 4/1968 Gellmann ..... 4/570
4,191,332 A 3/1980 DeLangis et al.
5,678,258 A * 10/1997 Healy ..... 4/601
5,788,160 A * 8/1998 Woog ..... 239/282
6,565,018 B1 5/2003 Degeyter

* cited by examiner

*Primary Examiner* — Davis Hwu

(57) ABSTRACT

The shower head apparatus has a first end spaced apart from a second end, a first tube extended from proximal to the first end, a second tube extended from proximal to the second end, a ball valve with lever threadably disposed in-line between the tubes, a pair of spaced apart 90 degree junctions with a swivel connecting the 90 degree junctions at the first end, an attachment collar connected to one swivel at the first end, a pair of spaced apart 90 degree junctions with a swivel connecting the 90 degree junctions at the second end, a head collar connected to one swivel at the second end, a positionally adjustable shower head with face connected to the head collar of the one swivel at the second end, and a plurality of nozzles disposed distally within the shower head face.

5 Claims, 4 Drawing Sheets

SHOWER HEAD APPARATUS

BACKGROUND OF THE INVENTION

Shower head and water flow problems are known in the art, yet no current device fully addresses the needs of a well designed shower head. For example, shower heads are notorious for allowing continued water flow, water siphoning, and water drip. Also, most shower heads do not provide ease of adjustment, if adjustment is at all provided for positioning the shower head. If provided, adjustment typically only includes directional positioning of the shower head water stream. The current apparatus provides adjustable water flow, water shutoff prior to the shower head, and height and directional adjustments of water delivery.

FIELD OF THE INVENTION

The shower head apparatus relates to shower heads and to shower water and shower head controls.

SUMMARY OF THE INVENTION

The general purpose of the shower head apparatus, described subsequently in greater detail, is to provide a shower head apparatus which has many novel features that result in an improved shower head apparatus which is not anticipated, rendered obvious, suggested, or even implied by prior art, either alone or in combination thereof.

To attain this, the shower head apparatus provides height and direction adjustment and also water volume control and shut off, independently of existing shower water controls. Of the important features provided by the apparatus is that the two swivels allow a user to adjust the location of the shower head within a wide range of movement—up, down, proximally, and distally with relation to the user. The swivels may also allow directional adjustment and are easily operated by a user's fingers, even with the apparatus in use. The directional adjustment of the shower head by the swivels is further complimented by the adjustment capabilities provided by the attachment collar and the head collar, both of which can be positioned anywhere within a 360 degree rotation. The plurality of nozzles is restricted to relatively closely spaced apart arrangement distally on the shower head face. This concentration of nozzles coupled with the flow reducer within the shower head provide for vigorous water delivery without excessive water volume, thereby saving water and heat energy costs.

An important feature is the ball valve with external lever that may be provided with a turn of 90 degrees. The lever may be parallel with the tubes, toward the shower head, when fully open, and perpendicular to the tubes when fully closed. A visually challenged user, whether physically or just from soap and shampoo, may therefore easily adjust the water flow to the shower head, from on to off or any position therebetween. This feature may be important for safety and for convenience. Importantly, the ball valve allows a user to turn off the water flow to the shower head without touching other water controls. This is an important water conservation feature as well as a feature of convenience. A user might, for example, originally adjust water flow and temperature from existing hot and cold controls, then use soap or shampoo as needed, then turn off the ball valve, lather as needed, and turn the ball valve back to an on position to complete a shower, without having to redo the existing hot and cold water adjustments.

The apparatus stops habitual shower head drip and also shower head siphoning that can cause drips. Negation of drip ensures abbreviated shower cleanup due to mineral buildup, splatter, and the like.

Thus has been broadly outlined the more important features of the improved shower head apparatus so that the detailed description thereof that follows may be better understood and in order that the present contribution to the art may be better appreciated.

An object of the shower head apparatus is to provide water shutoff separately from existing hot and cold water controls.

Another object of the shower head apparatus is to provide water flow control proximal to the shower head.

Another object of the shower head apparatus is to provide hand operated shower head height adjustment.

A further object of the shower head apparatus is to provide hand operated shower head directional adjustment.

An added object of the shower head apparatus is to negate water waste.

And, an object of the shower head apparatus is to negate aggravating shower head drip.

Yet another object of the shower head apparatus is to negate shower head water siphoning.

Still another object of the shower head apparatus is to negate excessive shower cleaning chores.

These together with additional objects, features and advantages of the improved shower head apparatus will be readily apparent to those of ordinary skill in the art upon reading the following detailed description of presently preferred, but nonetheless illustrative, embodiments of the improved shower head apparatus when taken in conjunction with the accompanying drawings.

DETAILED DESCRIPTION OF THE DRAWINGS

With reference now to the drawings, and in particular FIGS. 1 through 5 thereof, the principles and concepts of the shower head apparatus generally designated by the reference number 10 will be described.

Figure 1:
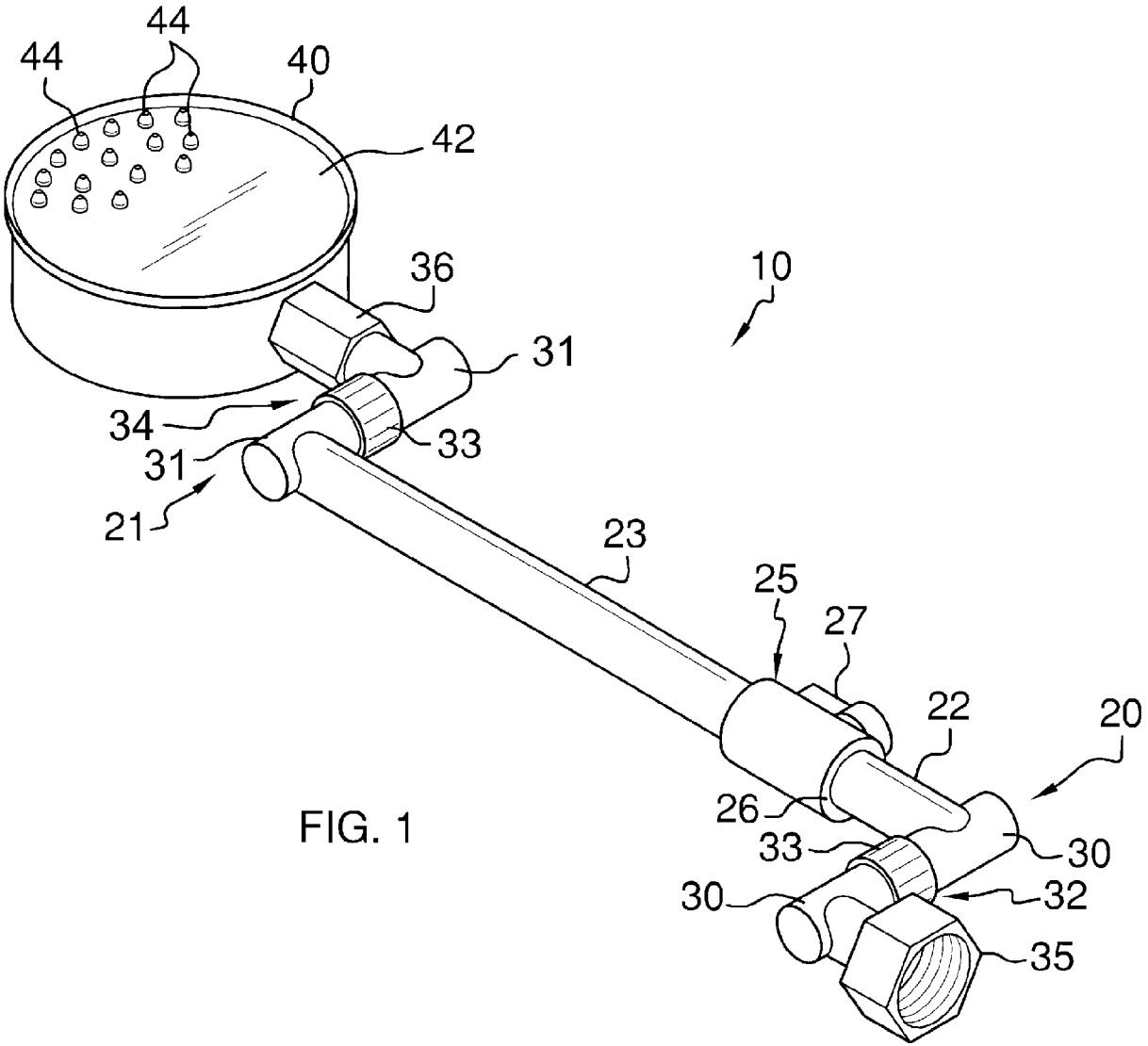
FIG. 1 is a perspective view, featuring the head face.

Referring to FIG. 1, the apparatus 10 partially comprises a first end 20 spaced apart from a second end 21.

Figure 3:
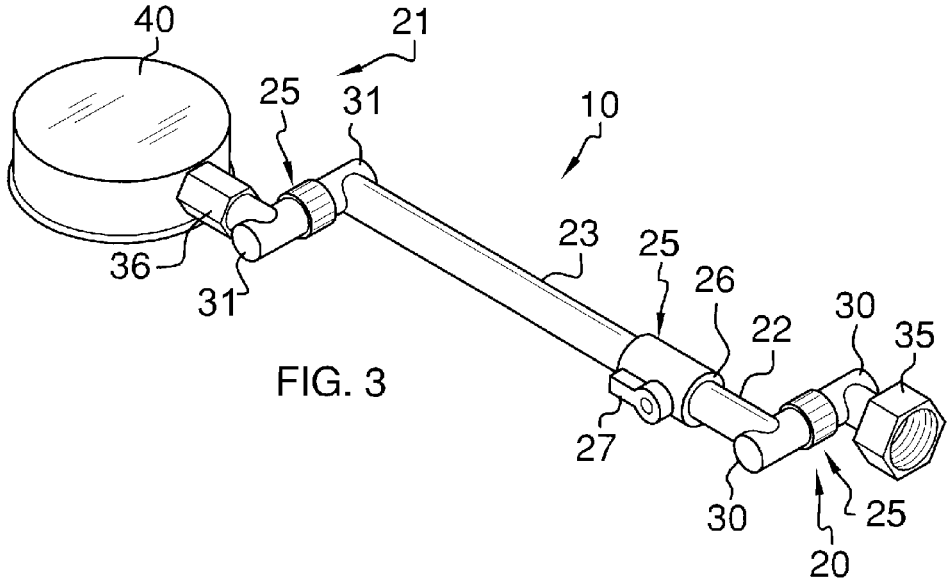
FIG. 3 is a perspective view.

Continuing to refer to FIG. 1 and referring also to FIG. 3, the first tube 22 is extended from proximal to the first end 20. The second tube 23 is extended from proximal to the second end 21. The ball valve 25 is threadably disposed in-line between the tubes. The ball valve 25 has an internally threaded sleeve 26 and an externally disposed lever 27 having 90 degrees of rotation. In a position parallel with the tubes and facing the shower head 40, the ball valve 25 is fully open. In a lever 27 position perpendicular to the tubes, the ball valve 25 is fully closed. The lever 27 may be positioned anywhere between fully open and fully closed to regulate water flow as desired.

Continuing to refer to FIG. 3, the pair of spaced apart 90 degree junctions 30 is disposed on the first tube 22 at the first end 20. A swivel 32 with finger grip 33 connects the 90 degree junctions 30 at the first end 20. The attachment collar 35 is connected to one swivel 32 at the first end 20 and allows for pivotally adjustable connection to an existing plumbing item.

Figure 4:
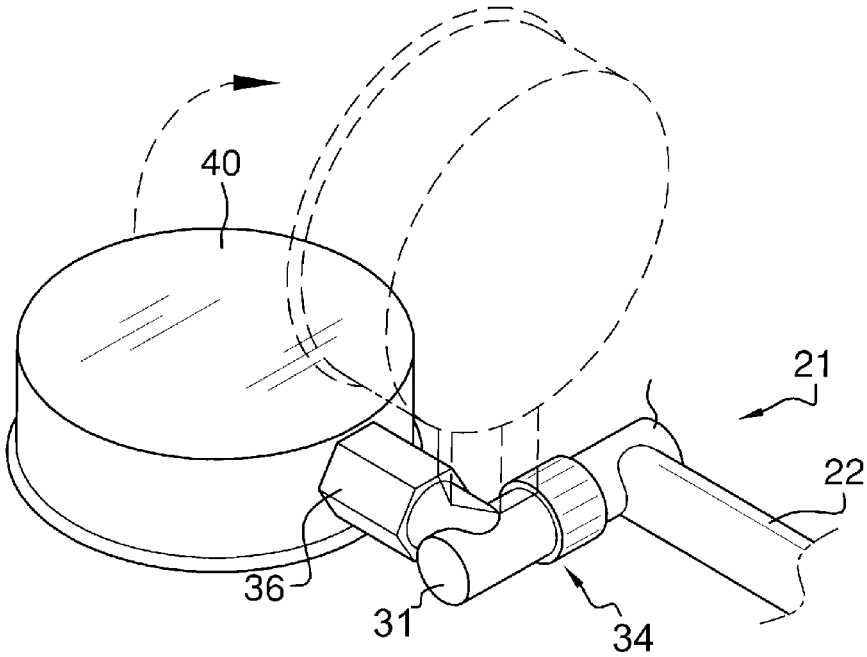
FIG. 4 is a perspective view of the head and proximal swivel with finger grip.

Continuing to refer to FIG. 3 and referring also to FIG. 1 and FIG. 4, a pair of spaced apart 90 degree junctions 31 is disposed on the second tube 23 at the second end 21. A swivel 34 with finger grip 33 connects the 90 degree junctions 31 at the second end 21. The head collar 36 connects to one swivel 34 at the second end 21 and allows pivotally adjustable connection of the rotationally positionable shower head 40 with face 42 at the second end 21.

Figure 2:
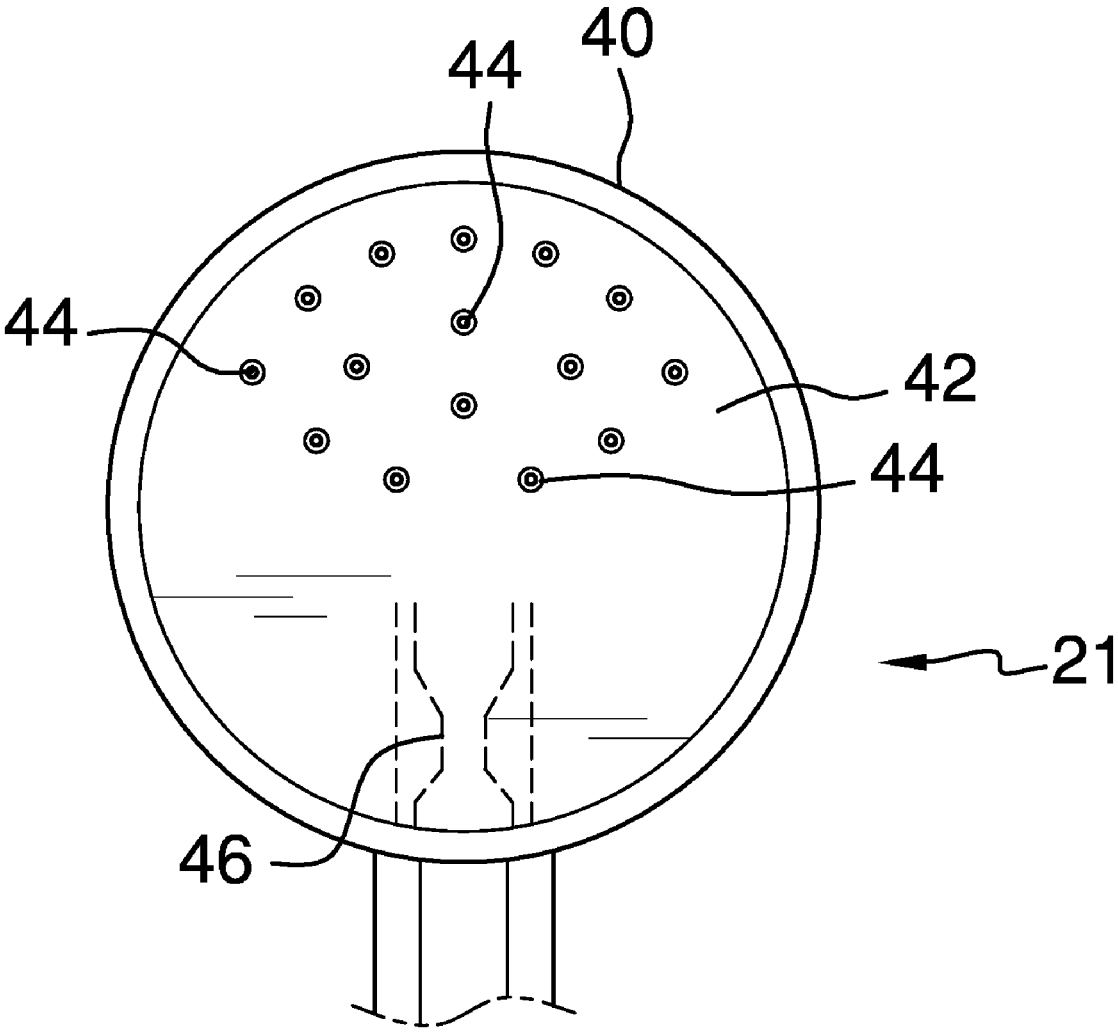
FIG. 2 is a face elevation view of the head.

Referring to FIG. 2, the flow reducer 46 is importantly disposed within the shower head 40. The plurality of nozzles 44 is importantly disposed distally within the shower head 40 face 42.

Figure 5:
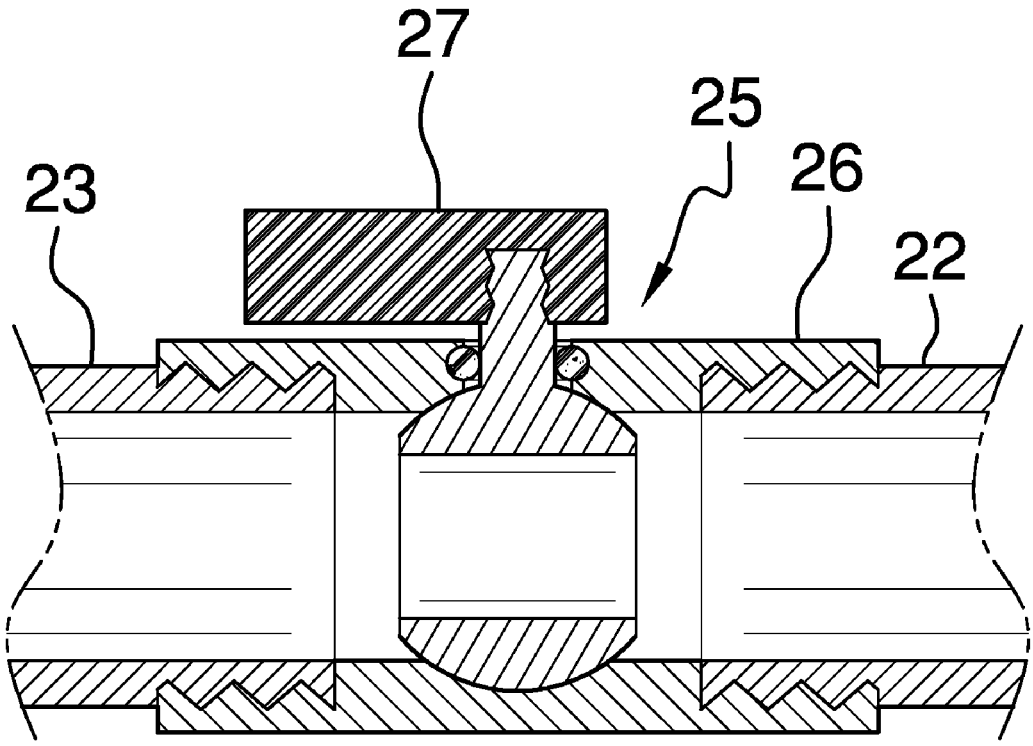
FIG. 5 is a cross sectional view of the ball valve.

Referring to FIG. 5, an important feature of the ball valve 25 with external lever 27 is that the lever 27 turns 90 degrees between fully off and fully on positions. The lever 27 is importantly parallel with the tubes, toward the shower head 40 when fully open, and perpendicular to the tubes when fully closed. The lever 27 is positioned anywhere between fully closed and fully open to control water flow volume as desired.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the shower head apparatus may be used.

What is claimed is:

1. A shower head apparatus comprising, in combination:
- a first end spaced apart from a second end;
- a first tube extended from proximal to the first end;
- a second tube extended from proximal to the second end;
- a ball valve with lever threadably disposed in-line between the tubes;
- a pair of spaced apart 90 degree junctions disposed on the first tube at the first end;
- a swivel connecting the 90 degree junctions at the first end;
- an attachment collar connected to one swivel at the first end;
- a pair of spaced apart 90 degree junctions disposed on the second tube at the second end;
- a swivel connecting the 90 degree junctions at the second end;
- a head collar connected to one swivel at the second end;
- a positionally adjustable shower head with face connected to the head collar of the one swivel at the second end;
- a plurality of nozzles disposed distally within the shower head face.

2. The apparatus according to claim 1 wherein the lever further comprises selective positioning anywhere between fully closed and fully open.

3. A shower head apparatus comprising, in combination:
- a first end spaced apart from a second end;
- a first tube extended from proximal to the first end;
- a second tube extended from proximal to the second end;
- a ball valve with lever threadably disposed in-line between the tubes;
- a pair of spaced apart 90 degree junctions disposed on the first tube at the first end;
- a swivel connecting the 90 degree junctions at the first end;
- an attachment collar connected to one swivel at the first end;
- a pair of spaced apart 90 degree junctions disposed on the second tube at the second end;
- a swivel connecting the 90 degree junctions at the second end;
- a head collar connected to one swivel at the second end;
- a positionally adjustable shower head with face connected to the head collar of the one swivel at the second end;
- a flow reducer disposed within the shower head;
- a plurality of nozzles disposed distally within the shower head face.

4. The apparatus according to claim 3 wherein the lever further comprises selective positioning anywhere between fully closed and fully open.

5. A shower head apparatus comprising, in combination:
- a first end spaced apart from a second end;
- a first tube extended from proximal to the first end;
- a second tube extended from proximal to the second end;
- a ball valve threadably disposed in-line between the tubes, the ball valve having an internally threaded sleeve and an externally disposed lever having 90 degrees of rotation between fully open and fully closed, the ball valve fully open when parallel with the tubes and oriented toward the second end;
- a pair of spaced apart 90 degree junctions disposed on the first tube at the first end;
- a swivel with finger grip connecting the 90 degree junctions at the first end;
- an attachment collar connected to one swivel at the first end;
- a pair of spaced apart 90 degree junctions disposed on the second tube at the second end;
- a swivel with finger grip connecting the 90 degree junctions at the second end;
- a head collar connected to one swivel at the second end;
- a positionally adjustable shower head with face connected to the head collar of the one swivel at the second end;
- a flow reducer disposed within the shower head;
- a plurality of nozzles disposed distally within the shower head face.

* * * * *